United States Patent [19]

Gross

[11] Patent Number: 4,882,786

[45] Date of Patent: Nov. 28, 1989

[54] HUNTING JACKET INCLUDING ARM SUPPORT FOR USE WHILE CARRYING A GUN

[76] Inventor: Steven E. Gross, 1237 Nuttman Ave., Fort Wayne, Ind. 46807

[21] Appl. No.: 269,362

[22] Filed: Nov. 10, 1988

[51] Int. Cl.[4] ..... A41B 1/00

[52] U.S. Cl. ..... 2/94; 2/102

[58] Field of Search ..... 2/69, 93, 94, 95, 102; 128/94

[56] References Cited

U.S. PATENT DOCUMENTS

| | | | |
|---|---|---|---|
| 1,266,688 | 5/1918 | Kassner . | |
| 1,468,991 | 9/1923 | Butner . | |
| 2,560,243 | 7/1951 | Peterson . | |
| 2,678,447 | 5/1954 | Bracken . | |
| 2,919,443 | 1/1960 | Kashiyama . | |
| 3,096,759 | 7/1963 | Coolbaugh | 128/94 |
| 3,221,958 | 12/1965 | Straight . | |
| 3,348,746 | 10/1967 | Stumpf . | |
| 3,559,640 | 2/1971 | Beckett | 128/94 |
| 4,275,468 | 6/1981 | Outlaw . | |
| 4,601,285 | 7/1986 | Whitchurch . | |
| 4,625,334 | 12/1986 | Proffer . | |

*Primary Examiner*—Ronald Feldbaum

*Attorney, Agent, or Firm*—David L. Ahlersmeyer

[57] ABSTRACT

A hunting jacket to aid a hunter in carrying a shotgun or rifle is disclosed, including a pair of sleeves and a pair of front lapels on which various pockets and a gun pad are provided. A sling-type forearm support is provided on the inside of the jacket. The forearm support is sewn to the inside of the shoulder portion of one lapel, and is releaseably attached to the inside of the opposite lapel prior to closing and fastening the lapels of the coat together. A recloseable vertical opening in the lapel provides access for a sleeve-covered forearm of the hunter to the forearm support. A handle may be incorporated within the forearm support structure for grasping by the hunter's hand. The jacket is used to support a hunter's forearm substantially parallel to the ground with the arm bent at an approximate right angle, whereby a shotgun or rifle is carried in the bend of the arm against the side of the hunter's body.

7 Claims, 2 Drawing Sheets

HUNTING JACKET INCLUDING ARM SUPPORT FOR USE WHILE CARRYING A GUN

BACKGROUND OF THE INVENTION

The present invention relates to garments worn by hunters using hand-carried firearms and, more particularly, to such a garment which aids the hunter in carrying a longarm, such as a shotgun or rifle, without causing fatigue.

When hunting wild game, a hunter will typically spend much time and cover much terrain in an effort to stalk and kill game, during which time the hunter must carry his firearm. A typical shotgun or rifle weighs approximately eight to nine pounds, which weight is distributed axially along the gun's length from the butt to the barrel. A hunter may become fatigued after an extended period of carrying his firearm, thereby adversely affecting his physical preparedness to engage in hunting, and detracting from his overall enjoyment of the sport.

The most common method of carrying a shotgun or rifle is for the hunter to simply grasp it in both hands. While this method is advantageous in terms of the hunter being able to quickly take aim and fire, a primary disadvantage is that grasping the firearm places a constant strain on the hunter's hands and forearms, which causes unwanted fatigue. Also, the hunter is left without a free hand to engage in other activities, such as clearing foilage or holding binoculars. Furthermore, in this method of carrying a firearm one is tempted to leave a finger on the gun's trigger, thereby creating a hazardous condition in the event the hunter trips and falls.

Another method of carrying a longarm during periods of nonuse when hunting is to equip the shotgun or rifle with a canvass or leather carrying strap attached to the firearm at opposite ends thereof. The strap is then typically placed over one shoulder with the firearm resting against the hunter's back. Although this method as applied to shotguns and rifles is popular in Europe, it has gained popularity in the United States only with respect to rifles. Several disadvantages associated with the use of a carrying strap include its general awkwardness during use, the discomfort resulting from the firearm hitting the hunter's back as he walks, the relative difficulty experienced in readying the gun for shooting, and the potentially hindering presence of the strap when the firearm is not being carried. These and other factors have contributed to the lack of widespread acceptance of the carrying strap as a solution to the problem of carrying a longarm during nonuse while hunting.

Some hunters have attempted to overcome the problems and disadvantages of the aforementioned methods of carrying a gun by bending their arm at an approximate right angle and supporting the gun on the forearm and against the back of the shoulder, such that the barrel of the gun is directed forwardly and toward the ground. While this method frees up one of the hunter's arms, the carrying arm still becomes fatigued as a result of being kept bent at a right angle against the weight of the gun. A hunter may lessen this fatigue by alternating affected muscle groups, i.e., grasping the lapel of his coat until his hand becomes fatigued and then releasing his hand and relying primarily on his bicep. Placement of the hunter's hand in the front pocket of a typical hunting vest or jacket does not provide adequate support for and positioning of the hunter's arm so as to permit effective carrying of a longarm as described herein. This is due primarily to the pocket's construction, and the orientation and placement of the pocket on the garment.

SUMMARY OF THE INVENTION

The present invention overcomes the problems and disadvantages associated with the above-described prior art methods and devices for carrying a longarm during non-use while hunting, by providing a hunting garment that includes means for supporting the hunter's forearm substantially parallel to the ground, whereby a longarm is supportable on the forearm and against the back of the shoulder, securely adjacent the hunter's side.

Generally, the invention provides a hunting garment including a forearm support to maintain the gun-carrying arm bent at an approximate right angle so that a longarm can rest on top of the forearm and against the back of the shoulder. In one aspect of the invention, the forearm support is attached to the inside of the garment and is accessible through an opening provided on the front of the garment adjacent the side thereof. The opening is positioned such that the forearm can be inserted and maintained parallel to the ground. The forearm support is adapted such that the hand associated with the forearm being supported is permitted to extend being the vertical centerline of the hunter's chest.

More specifically, the present invention provides, in one form thereof, a hunting jacket including a front having a pair of separate lapels. The lapel associated with the arm desired to be supported for carrying a shotgun or rifle includes an opening through which the hand and forearm are inserted. The opening communicates with a forearm support on the inside of the jacket. More specifically, the forearm support is supportingly attached at the shoulder of the lapel having the opening, thereby providing a sling-like receptacle by which the forearm received through the opening is supported. In one aspect of the invention, a proximal end of the receptacle is attached adjacent the opening, while a distal end of the receptacle is detachably connected to the opposite lapel across the centerline of the chest. A zipper may be used to attach the distal end to the opposite lapel to facilitate putting on and taking off the jacket, while providing support for the distal end of the receptacle when the jacket is being operably worn.

An advantage of the hunting garment of the present invention is that a hunter is capable of carrying his shotgun or rifle over long distances and during long periods of time without experiencing fatigue or the discomfort associated with other methods of carrying a longarm.

Another advantage of the hunting garment of the present invention is that a hunter may safely carry his shotgun or rifle without fatigue.

A further advantage of the hunting garment of the present invention is that a hunter is capable of safely and tirelessly carrying his shotgun or rifle, while keeping a free hand to engage in other activities such as clearing brush or handling binoculars.

Another advantage of the hunting garment of the present invention is that a hunter is capable of supporting his shotgun or rifle on his forearm and against the back of his shoulder, safely and snugly against his side, without experiencing fatigue.

A still further advantage of the hunting garment of the present invention, in one form thereof, is that the hunter is able to grasp a handle to help keep his forearm substantially parallel to the ground.

Another advantage of the hunting garment of the present invention, in one form thereof, is that a hunter is able to tirelessly carry his gun while keeping his trigger hand warm within a receptacle intermediate the outer shell of the garment and his chest.

Yet another advantage of the hunting garment of the present invention is that the firearm need not be equipped with any additional attachments in order for the hunter to be aided in carrying his gun to avoid fatigue.

The invention provides, in one form thereof, a garment to be worn by a person while hunting, to aid the person in carrying a longarm, i.e., a shotgun or rifle. The garment includes a shell member supportable on the person's upper torso. A support is incorporated within the shell member for supporting the person's forearm substantially adjacent the person's chest and substantially parallel to the ground. The support permits the hand associated with the supported forearm to cross the vertical centerline of the person's chest. In this manner, a longarm is supportable on the person's forearm adjacent the person's side in a bend of the arm created at the elbow. In one aspect of the invention, the support includes a handle for grasping by the hand associated with the supported arm. Accordingly, the supported arm is restrained against displacement when the garment is operably worn.

The invention further provides, in one form thereof, a hunting garment for wear by a hunter to aid the hunter in maintaining his arm bent at an approximate right angle for carrying a longarm, such as a shotgun or rifle. The garment includes a fabric body adapted to be worn on the upper portion of the hunter's torso. The fabric body has a front and a back joined by shoulders and sides. The body also has arm holes at an upper portion of the sides and a head hole intermediate the shoulders. A forearm support is attached to the inside of the fabric body for supporting a forearm of the hunter at an angle substantially parallel to the ground. The forearm support permits the hand of the supported forearm to extend across the vertical centerline of the hunter's chest. The hunting garment also includes an opening on the fabric body front. The opening provides access from the outside of the fabric body to the forearm support therein. Accordingly, the hunter's forearm may pass through the opening and be operably supported by the forearm support. In one aspect of the invention, the support comprises a single piece of fabric folded and attached to the inside of the fabric body. A baste stitch is made in the piece of fabric at a location that establishes the height and angle of support for the hunter's forearm. In another aspect of the invention, the fabric body front includes a pair of lapels, and the forearm support is attached to the inside of one lapel and is accessible by an opening therethrough. The support detachably connects to the other lapel to facilitate separating the lapels for putting on and taking off the hunting garment.

DETAILED DESCRIPTION OF THE PREFERRED EMBODIMENT

Figure 1:
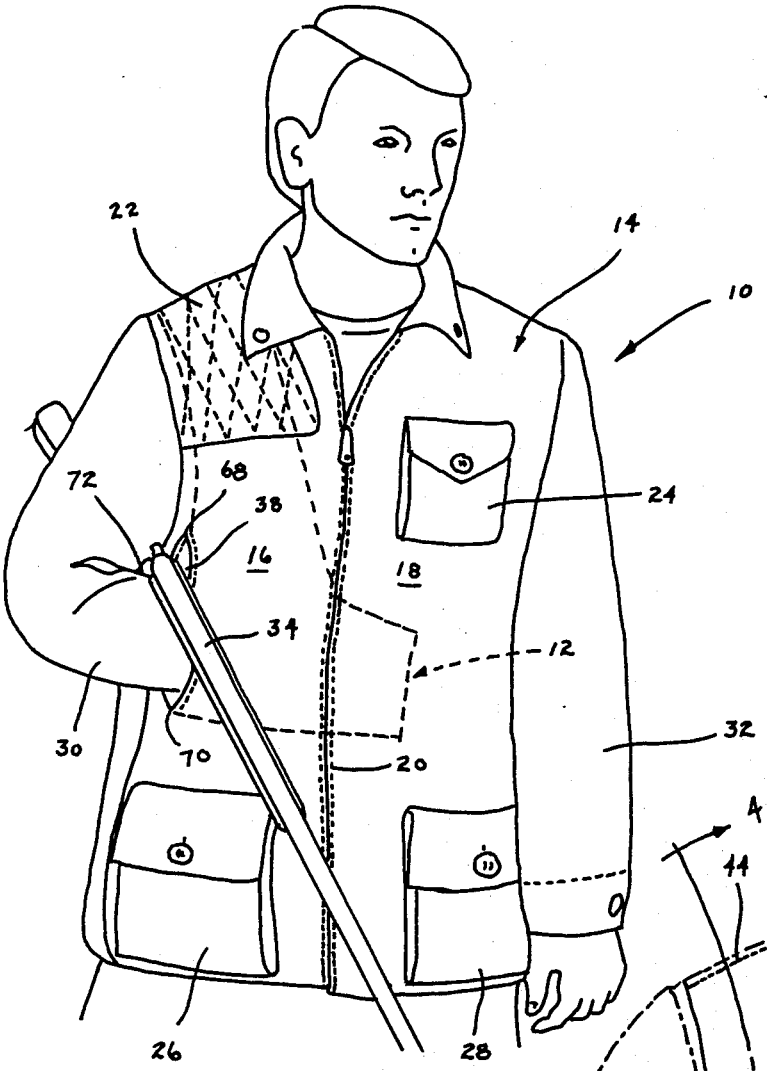
FIG. 1 is a front perspective view of a hunter carrying a shotgun or rifle while wearing a hunting jacket constructed in accordance with the principles of the present invention.

In an exemplary embodiment of the invention as shown in the drawings, and in particular by referring to FIG. 1, a hunter is shown wearing a hunting jacket 10 which incorporates a forearm support 12 in accordance with the present invention. Jacket 10 is of conventional construction, with the exception of the provision of support 12. More specifically, jacket 10 includes a fabric shell 14 having a front and back joined at shoulders and sides to provide arm holes at an upper portion of the sides and a head hole intermediate the shoulders. Shell 14 is preferably made of cotton duck or Cordura nylon fabric. The front of shell 14 includes separate right and left lapels 16, 18 which detachably connect to one another by means of a conventional zipper 20 to open and close the front of jacket 10. Zipper 20 is centered on the front of jacket 10 and, in its closed position, will represent herein the vertical centerline of the chest of the hunter.

The front of jacket 10 also includes a gun pad 22, comprising a patch of suede quilted onto the shoulder of the jacket against which the butt of the firearm rests when shooting. Various pockets are also provided on the front of shell 14, including an upper pocket 24 for carrying personal items such as cigarettes and toilet paper, and a pair of lower pockets 26, 28 in which shotgun shells or rifle ammunition is stored for quick and easy access. It should be noted that lower pockets 26, 28 are located substantially below the level of the hunter's elbow and include top flaps permitting easy access to the pocket from the top thereof.

Jacket 10 further includes right and left long sleeves 30, 32 attached to respective arm openings of shell 14. While the preferred embodiment of the present invention is presented as a long sleeved hunting jacket, it will be understood that other hunting garments, including a hunting vest, may also incorporate a forearm support 12 in accordance with the principles of the present invention. As will be further described hereinafter, support 12 aids the hunter in maintaining his arm bent at an approximate right angle for carrying a longarm 34, i.e., a shotgun or rifle, such that the stock or barrel rests on top of the hunter's supported forearm and the butt contacts against the back of the hunter's shoulder, as shown in FIG. 1. For safety's sake, it is important that longarm 34 be retained snugly against the hunter's side and that the barrel be directly forwardly and toward the ground.

Figure 2:
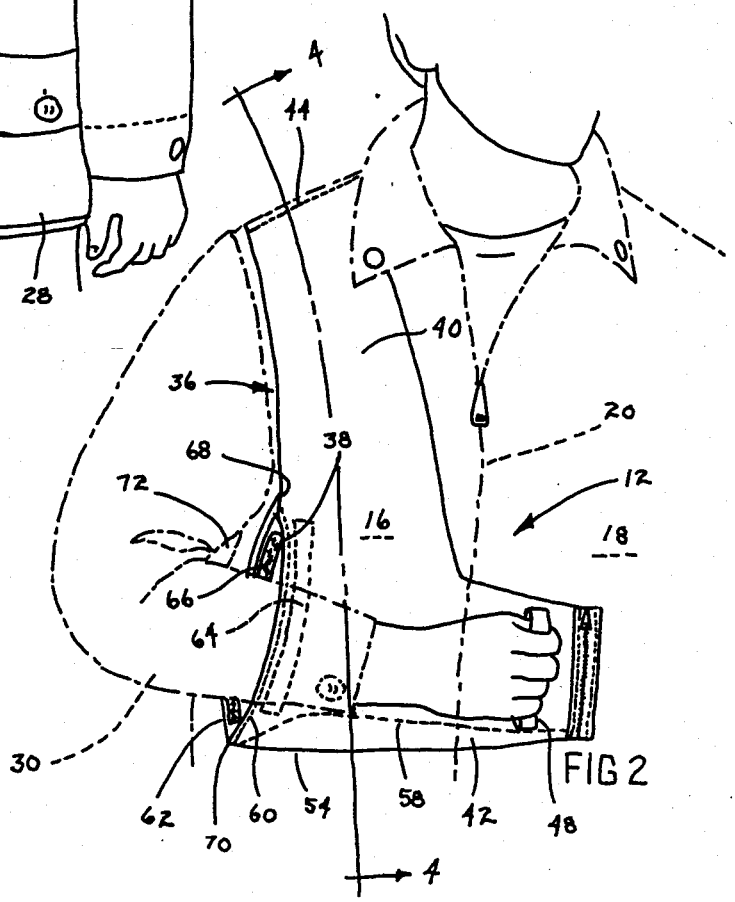
FIG. 2 is a fragmentary front perspective view of the hunter and hunting jacket of FIG. 1, wherein the outer covering of the jacket is shown in phantom in order to show the forearm support ordinarily concealed beneath the outer shell.
Figure 3:
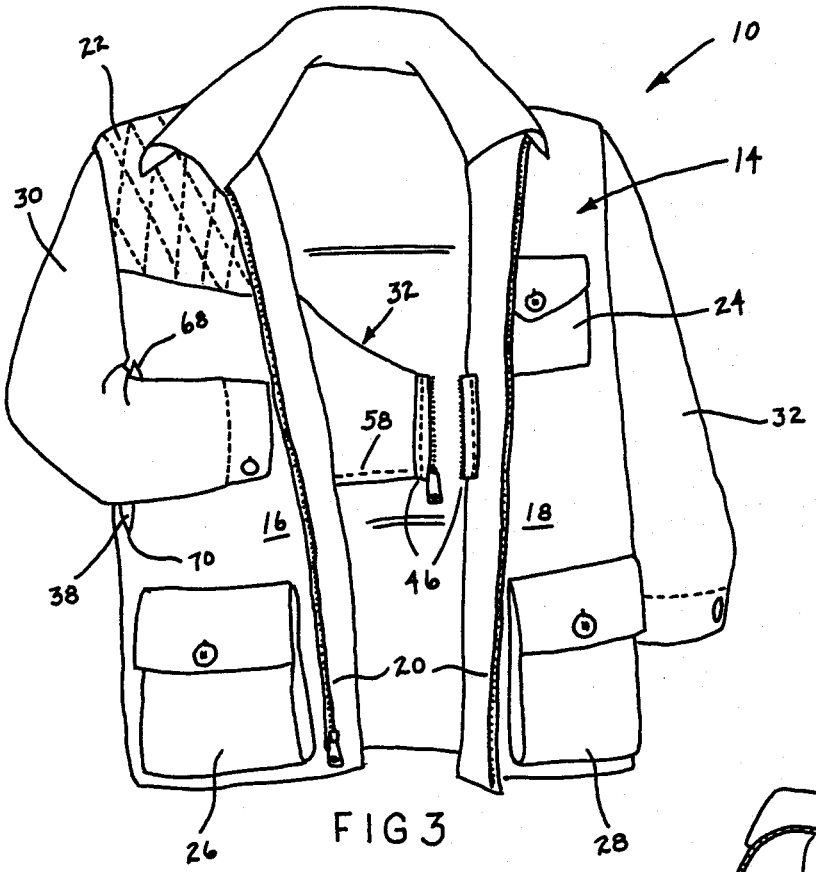
FIG. 3 is a front perspective view of the jacket of FIG. 1, wherein the front lapels are opened to expose means for attaching the forearm support associated with one lapel to the other lapel prior to closing the jacket.
Figure 4:
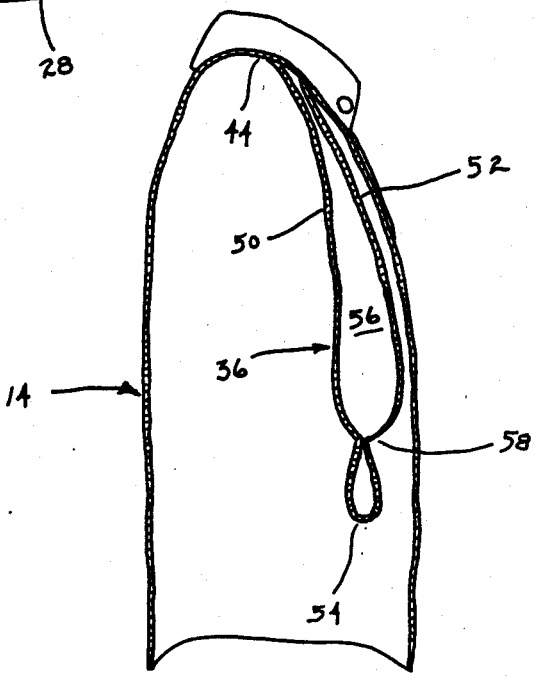
FIG. 4 is a fragmentary sectional view of the jacket of FIG. 1, taken along the line 4—4 in FIG. 2 and viewed in the direction of the arrows, particularly showing the height adjustment basting stitch of the forearm support of FIG. 2.

Reference will not be made to FIGS. 2–4 for a description of arm support 12 in accordance with a preferred embodiment of the present invention, wherein support 12 comprises a sling 36 disposed on the inside of shell 14 intermediate lapels 16, 18 and the front of the hunter's body. Support 12 also comprises an opening 38 in lapel 16 to provide access for the hunter's arm covered by sleeve 30 to pass from outside jacket 10 to sling 36 within. As shown in FIG. 2, sling 36 is L-shaped, having a vertical upwardly extending portion 40 and a horizontally extending portion 42.

Sling 36 is supportingly attached to the inside of shell 14 at three location; namely, at the extreme top of vertical portion 40, and at the opposite ends of horizontal portion 42. More specifically, the extreme top of vertical portion 38 is securely sewn to the shoulder portion of shell 14 at 44. Likewise, a proximal end of horizontal portion 42 is securely sewn about the peripheral edge of opening 38 on the inside of shell 14. The opposite distal end of horizontal portion 42 is detachably connected to the inside of lapel 18 by means of a zipper 46, as illustrated in its zipped and unzipped states in FIGS. 2 and 3, respectively. A handle 48 may optionally be provided within sling 36 at the distal end of horizontal portion 42, as shown in FIG. 2. Handle 48 is preferably a vertically oriented strap of nylon webbing, leather or the like, attached at its opposite ends to the fabric of sling 36.

Referring now to FIG. 4, a sectional view of jacket 10 illustrates a further feature of the present invention, in one form thereof. Specifically, sling 36 may be constructed of a single piece of fabric having opposite ends 50, 52 that are folded one upon the other, resulting in a generally folded edge 54 and a receptacle area 56 defined intermediate rearwardly disposed end 50 and forwardly disposed end 52. Ordinarily, sling 36 is adapted and sized to support the hunter's forearm on folded edge 54 within receptacle 56. However, a baste stitch 58 may be made so as to attach opposite ends 50, 52 together along a line generally parallel to and spaced above folded edge 54, whereby the hunter's forearm is supported along stitch 58 which determines the height and angular orientation of the forearm relative to the ground. Accordingly, baste stitch 58 may be moved upwardly or downwardly to accomodate individual hunters, whereby the supported arm is always supported substantially parallel to the ground.

Referring once again to opening 38 on the front of lapel 16, it will be appreciated that opening 38 comprises a vertical slit having forward and rearward overlapping edges 60 and 62, as shown in FIG. 2. Furthermore, opening 38 is located adjacent the side of jacket 10 to permit easy entry of the forearm covered b sleeve 30, and is vertically centered on the jacket at the approximate location of the elbow. As illustrated in FIGS. 1–3, edges 60 and 62 intersect above and below the supported forearm at points 68 and 70, respectively. In this manner, opening 38 is sized and positioned to accommodate the sleeve-covered forearm at a variable height determined by fold 54 or, alternatively, baste stitch 58.

As discussed earlier with respect to the attachment of sling 36 to opening 38, where sling 36 is a single piece of folded fabric and opening 38 is a slit, the lower proximal edge portions of rearward and forward ends 50, 52 attach to rearward and forward edges 62, 60 of opening 38, respectively. In this arrangement, folded edge 54 is attached to opening 38 at point 70. This provides continuous access from opening 38 into receptacle 56. Edges 60 and 62 may optionally include cooperating strips of hook fabric 64 and loop fabric 66, respectively sewn thereto, for releasably attaching the edges together when opening 38 is not being used.

In operation, jacket 10 is placed upon the hunter with zippers 20 and 46 unattached, as shown in FIG. 3. Zipper 46 is then engaged to attach the distal end of horizontal portion 42 of sling 36 to the inside of lapel 18, as shown in FIG. 2. The hunter may then close the jacket by connecting lapels 16, 18 at zipper 20. The hunter then inserts his sleeve covered arm through opening 38 so that the hand associated with the supported arm extends beyond the vertical centerline of the chest defined by closed zipper 20. The hand may then grasp handle 48 to help restrain the arm from displacement out of support 12.

It is important in practicing the present invention that a portion of the supported arm be permitted to extend sufficiently across the vertical centerline of the chest so that a space 72 defined by the bend of the arm and the side of the hunter's body is small enough to snugly retain the longarm therein. In this manner, stability and control during carrying of the firearm are appreciably enhanced.

It will be appreciated that while the present invention has been described with respect to the provision of a single forearm support with access from the hunter's right side, access from the left side could also be provided. Furthermore, a hunting jacket providing support of either and/or both arms in accordance with the principles of the present invention is also contemplated.

It will be appreciated that the foregoing is presented by way of illustration only, and not by way of any limitation, and that various alternatives and modifications may be made to the illustrated embodiment without departing from the spirit and scope of the invention.

What is claimed is:

1. A hunting jacket for wear by a hunter to aid the hunter in maintaining his arm bent at an approximate right angle for carrying a longarm, such as a shotgun or rifle, comprising:

a fabric shell adapted to rest upon the hunter's shoulders and upper torso, including a pair of separate front lapels, each lapel having an inner surface adjacent the hunter's body and an opposite outer surface;

an opening extending through one of said pair of front lapels, said opening providing communication between the respective outer and inner surfaces of said one lapel; and receptacle means, supportingly attached to the respective inner surfaces of said pair of lapels and in communication with said opening, for supporting a forearm of the hunter received through said opening, said receptacle means being such that the hand associated with the supported forearm is permitted to extend across the vertical centerline of the hunter's chest, whereby a longarm is supportable on the hunter's forearm adjacent the hunter's side in a bend of the arm created at the elbow.

2. The hunting jacket of claim 1 in which;

said receptacle means is detachably connected to the inner surface of the other of said pair of front lapels, whereby said pair of lapels may be separated for putting on and taking off of the hunter.

3. The hunting jacket of claim 2 in which:

said receptacle means is detachably connected to the inner surface of the other of said pair of front lapels by means of a zipper.

4. The hunting jacket of claim 1 in which:

said receptacle means is attached to said one lapel both adjacent the hunter's shoulder and adjacent said opening.

5. The hunting garment of claim 1 in which:

said receptacle means comprises a single piece of fabric having opposite edge portions that are folded one upon the other to provide a generally folded edge, said opposite edge portions being attached to the inside of said one lapel such that the hunter's forearm is supported in said folded edge below the point of attachment of said opposite edge portions to said one lapel.

6. The hunting garment of claim 5 in which:

said piece of fabric includes a stitch that attaches said opposite edge portions together along a line generally parallel to and spaced inwardly from said folded edge, whereby the hunter's forearm is supported along said stitch intermediate said stitch and the point of attachment of said opposite edge portions to said one lapel at a height determined by the distance of said stitch from said folded edge.

7. The hunting garment of claim 1 in which:

said receptacle means includes a handle for grasping by the hand associated with the supported forearm, whereby said supported forearm is restrained against displacement.

* * * * *